US005724318A

United States Patent [19]

Mossuz

[11] Patent Number: 5,724,318

[45] Date of Patent: Mar. 3, 1998

[54] TIMEPIECE COMPRISING ROTARY INDICATING MEANS

[75] Inventor: Gabriel Mossuz, Saint-Blaise, Switzerland

[73] Assignee: Fabrique d'Ebauches de Sonceboz S.A., Sonceboz/Be, Switzerland

[21] Appl. No.: 257,127

[22] Filed: Jun. 9, 1994

[30] Foreign Application Priority Data

Jun. 16, 1993 [EP] European Pat. Off. ..... 93810433

[51] Int. Cl.[6] ..... G04B 19/20

[52] U.S. Cl. ..... 368/37; 368/38

[58] Field of Search ..... 368/24–30, 37, 368/38, 35

[56] References Cited

U.S. PATENT DOCUMENTS

| | | | |
|---|---|---|---|
| 1,874,348 | 8/1932 | Prenszner | 368/37 |
| 2,603,940 | 7/1952 | Packard | 368/37 |
| 3,673,789 | 7/1972 | Tsuuki et al. | 368/37 |
| 3,696,606 | 10/1972 | Scholz | 368/37 |
| 3,777,475 | 12/1973 | Grossan | 58/126 |
| 4,611,925 | 9/1986 | Vuilleumier et al. | 368/28 |

FOREIGN PATENT DOCUMENTS

| | | |
|---|---|---|
| 165455 | 12/1985 | European Pat. Off. . |
| 366610 | 5/1990 | European Pat. Off. . |
| 54-70867 | 6/1979 | Japan . |
| 62-177475 | 8/1987 | Japan . |
| 6-157956 | 11/1994 | Japan . |
| 290654 | 5/1953 | Switzerland . |
| 318902 | 3/1957 | Switzerland . |
| 324270 | 10/1957 | Switzerland . |
| 662696 | 10/1987 | Switzerland . |
| 662920 | 11/1987 | Switzerland . |

*Primary Examiner*—Bernard Roskoski
*Attorney, Agent, or Firm*—Oliff & Berridge

[57] ABSTRACT

A timepiece includes a date indicator with inner teeth moving angularly by one step per day. An indication control star meshes with the inner teeth of the indicator. A pinion that is integral and coaxial with the star drives an indicator wheel on which an indication arbor is centrally disposed. The rotary indicating structure is driven by the date indicator through the indication arbor and is intended to indicate cyclic parameters such as the date, the phase of the moon, the user's "cash balance," etc. Various types of indication, all controlled by the date indicator, make it possible to produce a wide range of watches of simple design with different display combinations.

22 Claims, 4 Drawing Sheets

TIMEPIECE COMPRISING ROTARY INDICATING MEANS

FIELD OF THE INVENTION

This invention relates to timepieces, and more particularly to a timepiece of the type having a date indicator with an inner toothing, moving angularly by one step per day.

BACKGROUND OF THE RELATED ART

U.S. Pat. No. 4,611,925 describes a calendar time piece having a date-display hand driven by a date ring with outer teeth and coupling means. Such a movement has numerous drawbacks. The outer teeth presumably do not exist on the prior movement because they would be of no use there. Hence, this referance discloses a modification to the prior art movement in order to produce the claimed movement. Moreover, the fabrication of such teeth entails significant difficulties for mass production, such as deformations of the ring, problems of planeness, of cutting, etc. These problems can be the source of a very high rate of rejects. Production costs of the ring then become prohibitive. The date ring having outer teeth is narrower than the date indicator of an aperture-type watch (see col. 2, lines 32–39). With a wider ring, in fact, it would not be possible to integrate the various elements for driving the display hand. Therefore, the date ring as defined in the cited reference cannot be used for displaying the date through an aperture since there is not enough space to inscribe the numbers on it. Since this indicating function is the main, essential function of a date indicator such as is known from the prior art, the date ring described in the cited reference has an essentially different shape, operation, and function from a date indicator used in prior art watches of the aperture type. The date ring described is simply a driving ring having driven inner teeth and driving outer teeth. Furthermore, the dial support heightens the whole assembly. The distance between the dial and the date ring is very substantial. With such a design, even if the date figures could be written on the ring, the resultant display would not have good legibility characteristics because the numbers would be too far way from the dial. What is more, four cutting operations are necessary for producing the driving parts, and several new parts, including the date bridge, are added to the original frame for driving the hand.

SUMMARY OF THE INVENTION

It is an object of this invention to provide an improved timepiece of simplified design, offering greater possibilities of indication.

To this end, the timepiece according to the present invention, comprises at least one rotary indicating means driven by the date indicator.

This rotary indicating means is chiefly intended to indicate cyclic parameters such as the date, the phase of the moon, a "cash balance" to be explained below, etc. The inventive timepiece permits indication of the date through an aperture and/or the display of at least one such cyclic parameter. The duration of which may be expressed by a time function, preferably dependent upon the date, via at least one rotary display means.

The date indicator used may be identical to that used in conventional aperture-type watches. The indicator may be of conventional width and the numbers indicating the date can be inscribed on it. Thus, the date indicator offers more possibilities of indication than a simple driving ring. The date indicator comprises inner teeth which are both driven and driving teeth. The distance between the date indicator and the dial remains slight, thus giving the whole assembly good legibility. Just two cuttings are necessary for producing the driving parts of the rotary display. Only a jumper spring (of minimal cost) is added to the frame. Moreover, the specific clearance between the teeth of the intermediate star-wheel and those of the date indicator performs a dual function: it allows shortening of the duration of the step (jump) transition of the rotary display means, and it avoids any disturbance of that means if the crown is rotated beyond a given angular limit in the opposite direction from normal operations. Furthermore, the aperture indicating the date may be disposed at any angular position of the dial.

BRIEF DESCRIPTION OF THE DRAWING

A preferred embodiment of the invention will now be described in detail with reference to the accompanying drawings, in which.

DETAILED DESCRIPTION OF PREFERRED EMBODIMENTS

Figure 1:
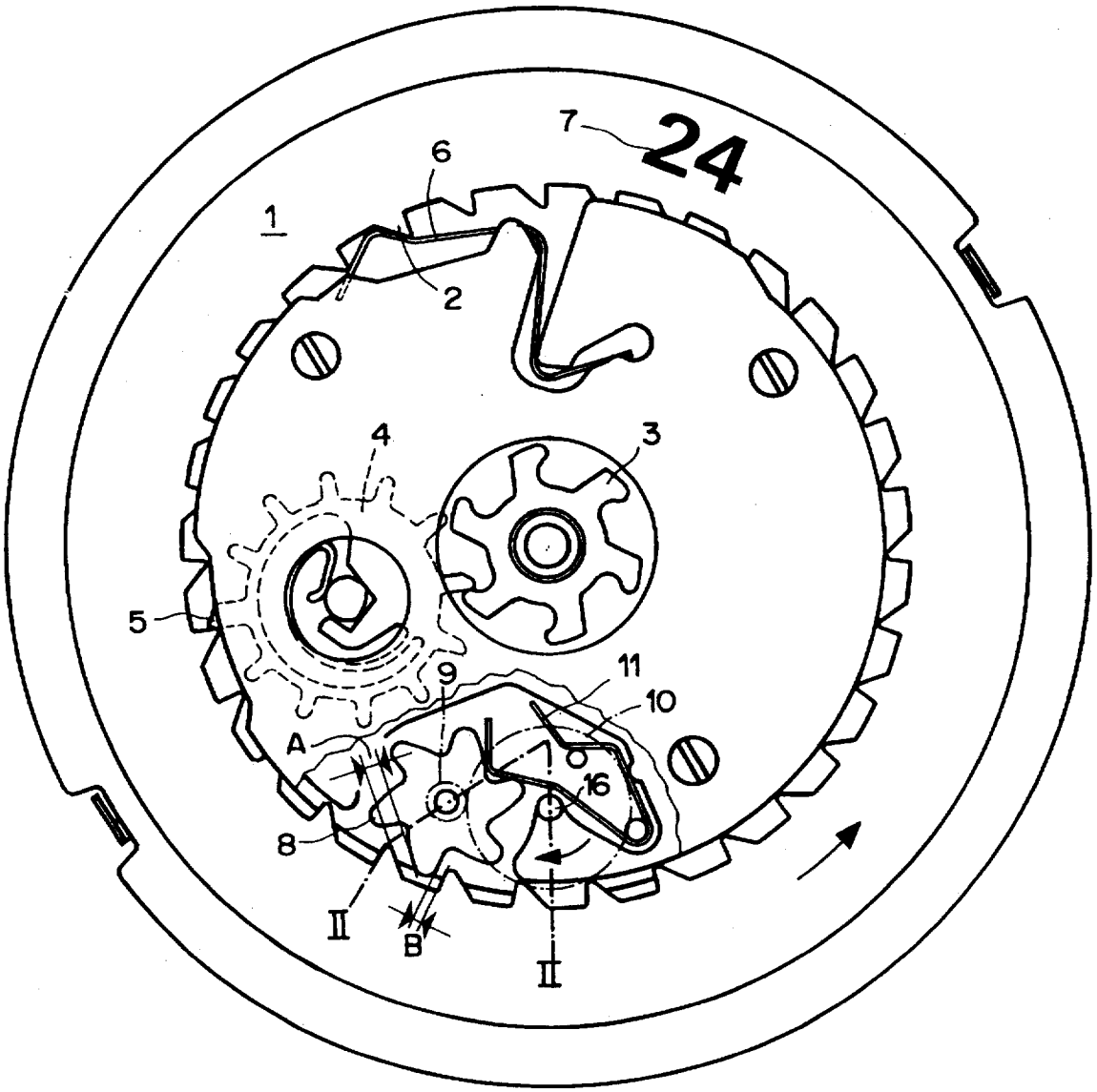
FIG. 1 is a top plan view of the inventive timepiece, the rotary indicating means being omitted.

FIG. 1 shows a timepiece movement according to the present invention, illustrating only those elements that are necessary for the understanding of the following description. A date indicator 1 of a conventional type is driven rotatingly by an hour wheel 3 and a date-driving wheel 4. Wheel 3 effects two revolutions per day, while wheel 4 effects only one revolution per day. Owing to this type of drive, indicator 1 advances one step per day. This movement takes place in the shortest possible time, preferably at midnight. Ring 1 comprises thirty-one teeth 2, each corresponding to one day of the month. A jumper spring 6 of date ring 1 ensures the rapid advance of the date ring when it is driven by tooth 5 of date-driving wheel 4, as well as its positioning between steps.

The device described above corresponds to that of a conventional movement intended to indicate the date. Date indications 7 are disposed in order on date indicator 1, the main function of which is then to indicate the day of the month through an aperture provided for that purpose in the dial.

The timepiece according to the present invention uses the aforementioned elements, in order to drive at least one rotary indicating means 12 (FIGS. 2–5) permitting the indication of any cyclic parameter. The duration of the cyclic parameter can be expressed by a time function, preferably dependent upon the day of the month, e.g., the phase of the moon, the "cash balance," the date, or the like. An indication-control star-wheel 8 meshes with the inner teeth 2 of indicator 1. A pinion 9, integral and coaxial with star 8, in turn drives an indication wheel 10 on which an indication arbor 16 (FIG. 2) is centrally disposed. It is this indication arbor 16 which drives the rotary indicating means 12. A jumper spring 11 of control star 8 stabilizes this star between steps and regulates the rapid advance of indicating means 12 in order to permit the fastest possible step transition.

Figure 2:
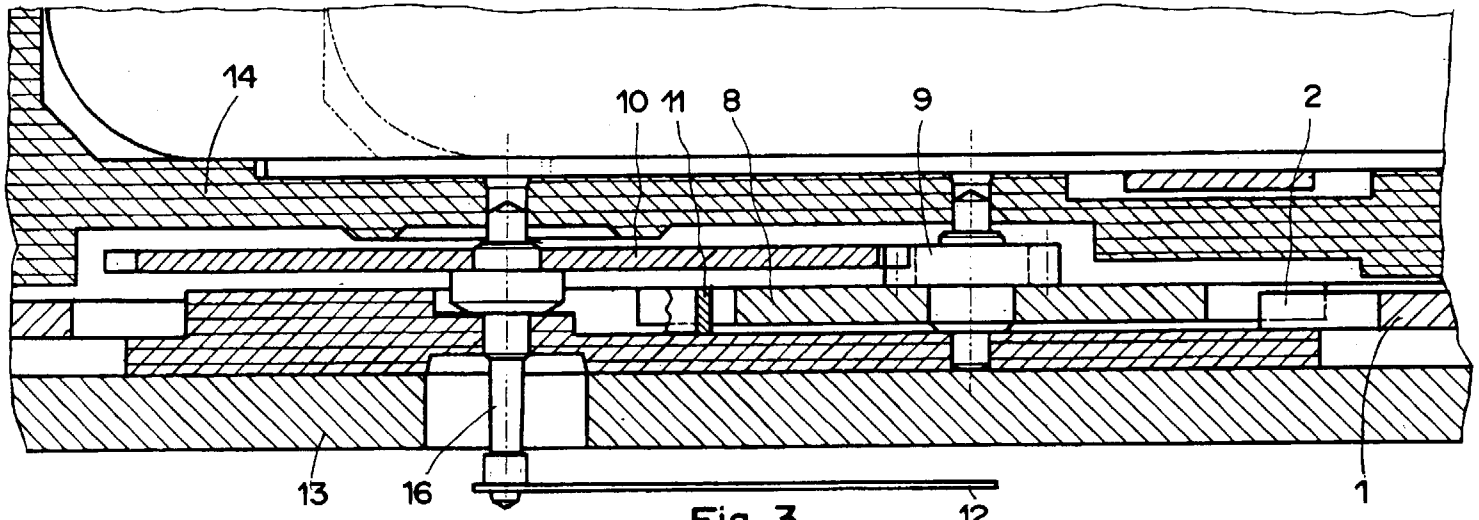
FIG. 2 is a section taken on the line II—II of FIG. 1, on a larger scale, including an indicating hand.
Figure 3:
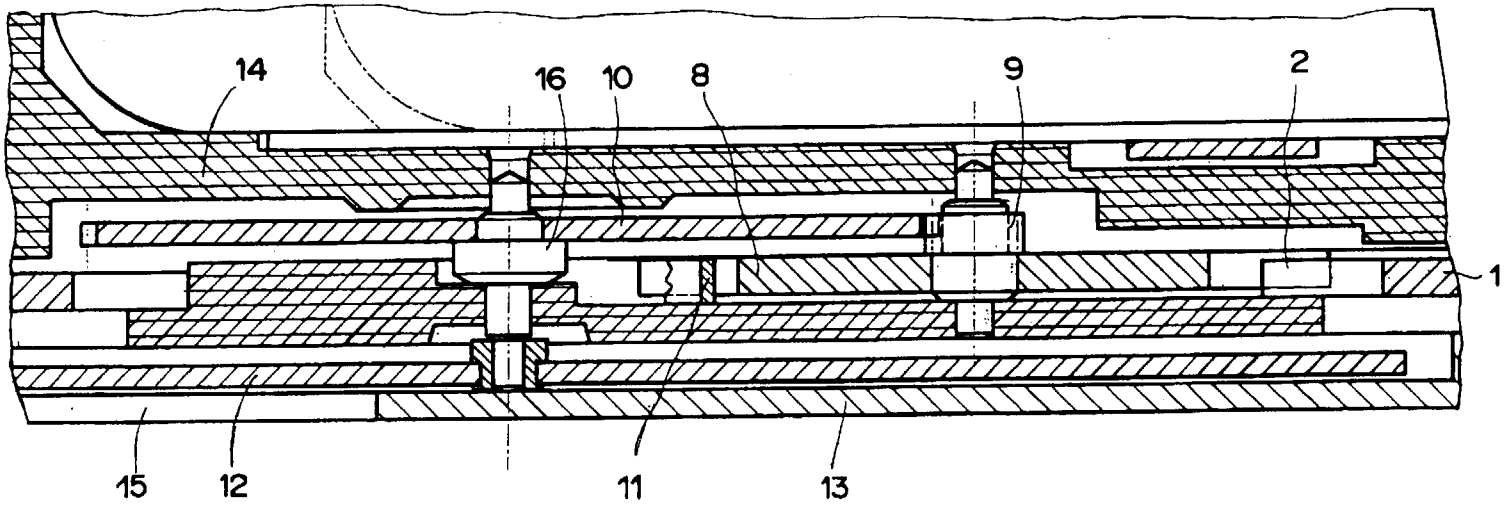
FIG. 3 is a section taken on the line II—II of FIG. 1, on a larger scalers including a rotary disk.
Figure 4:
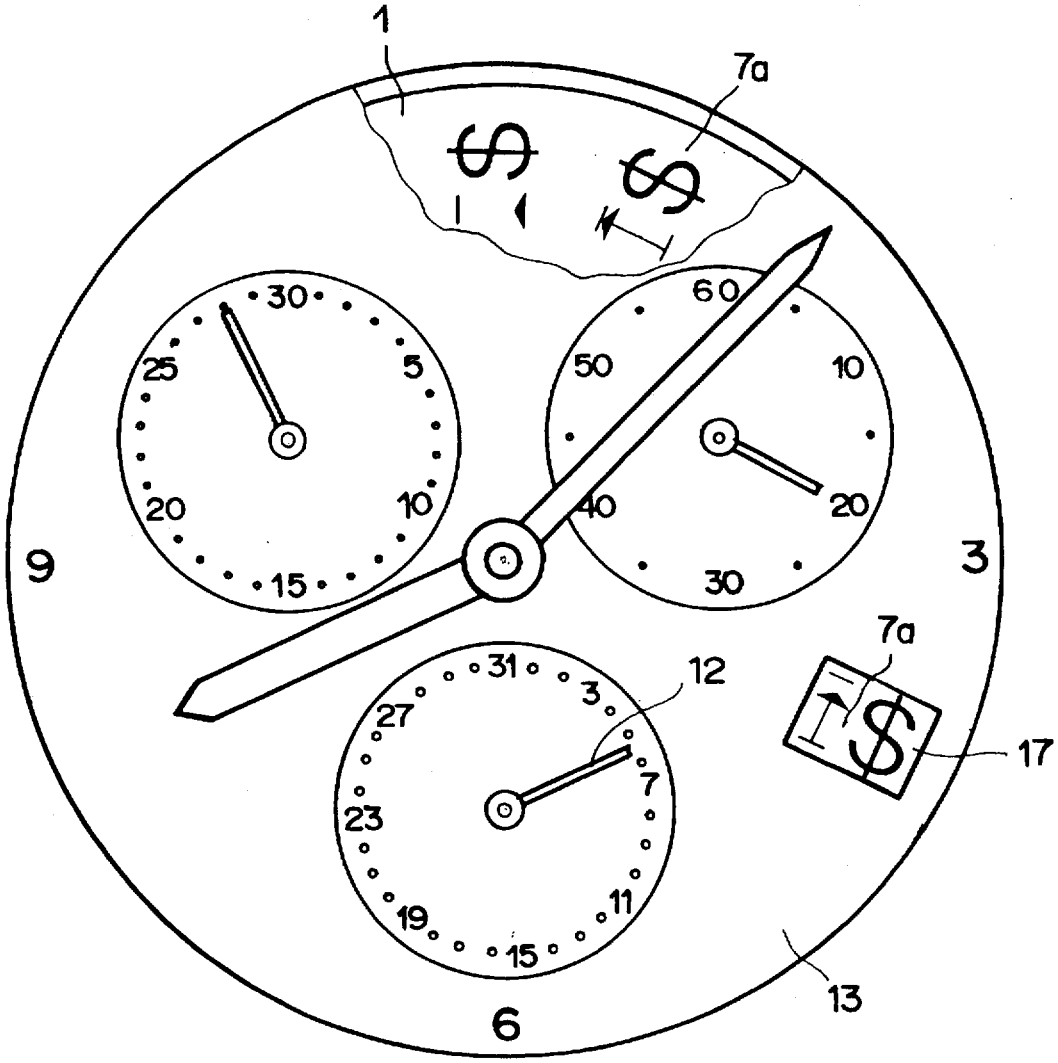
FIG. 4 is a top plan view of a dial for the inventive timepiece indicating the date by means of a hand and a "cash balance" by means of an aperture.
Figure 5:
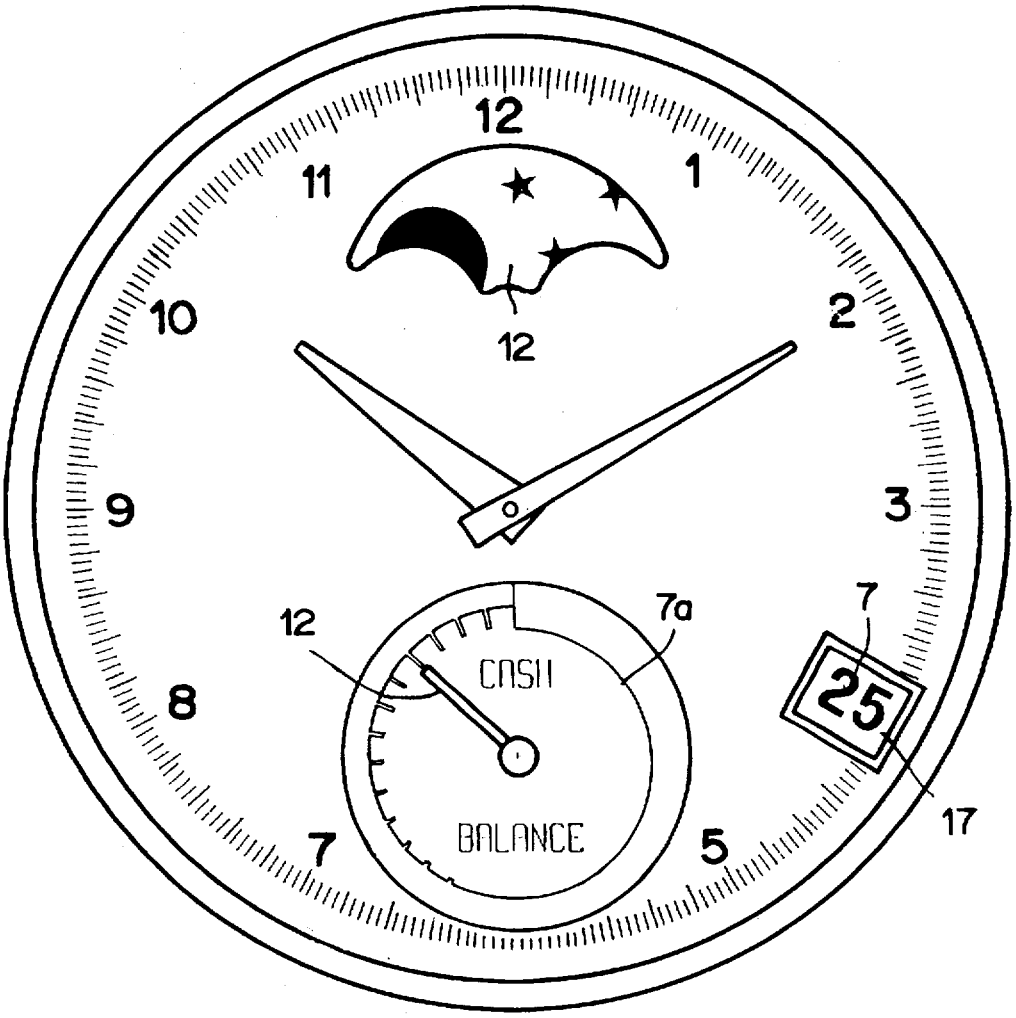
FIG. 5 is a top plan view of a dial for the inventive timepiece indicating the phase of the moon, a "cash balance," and the date.

Rotary indicating means 12 may vary according to the embodiment and/or according to the parameter to be indicated. For example, the rotary indicating means 12 in FIGS. 2 and 4 is a hand indicating the date; in FIG. 3, as well as in FIG. 5 (at 12 o'clock), means 12 is a rotary disk reproducing the lunar cycle through a conventional aperture of suitable shape; and in FIG. 5 (at 6 o'clock) means 12 is a rotary hand indicating the "cash balance," i.e., the amount of the user's bank balance (and/or cash on hand) still available until deposit of the next paycheck. In FIG. 5, the "cash balance" indication 7*a* is a circular strip that decreases in width along the circular path of the indicator. The maximum width is at the beginning of the path (after deposit of the paycheck, e.g., at the beginning of the month; the bank balance is then sizable), and the minimum width is toward the end of the month, for instance, prior to deposit of the next paycheck. The strip may be followed by a series of angularly disposed grooves, as shown in FIG. 4, standing for the few days preceding deposit of the paycheck, when the bank balance might become critical or overdrawn. It will be noted that the "cash balance" indication may take a multitude of forms. It suffices for the visual presentation to show the usual evolution of the bank balance as a function of time, and preferably as a function of the days of a month. The "cash balance" indication 7*a* may use any symbol, sign, or the like, giving the user an indication of the amount of his bank balance. For instance the indication 7*a* may include a piggy bank filled in accordance with the amount of the balance, or a monetary symbol such as a dollar sign, shown in different sizes proportional to the amount of the bank balance. The symbol may be accompanied by an arrow, the height of which indicates the size of the balance (FIG. 4), etc. According to the modification shown in FIG. 4, the "cash balance" indications 7*a* are distributed along date indicator 1 in place of the date indications 7 to be found on conventional watches and communicated through an aperture 17. Moreover, "cash balance" indication 7*a* may be used with any kind of timepiece serving to indicate the "cash balance".

According to other modifications of the present invention, a rotary indicating means 12 of a type similar to that serving to indicate the date may likewise be used to indicate the number of the week in the month or in the year.

When date indicator 1 moves a step, it acts upon indication-control star-wheel 8; control pinion 9 then drives indication wheel 10, causing an angular displacement of rotary indicating means 12. The extent of this angular displacement depends upon the number of teeth of the wheels and the gear ratios between the wheels and the pinions. These ratios are determined as a function of the type of indication. For example, in the case where the date is indicated (FIGS. 2 and 4), the numbers of teeth and gear ratios are established in such a way that the hand moves one step per day, following the same cycle as the date indicator. In the case of an indication of the phase of the moon, the cycle of indication means 12 is slightly shorter than that of the date ring so as to correspond to the actual lunar cycle.

Moreover, in order to achieve maximum user convenience, a clearance A is determined between the tooth 2 and the active tooth of control star 8. The clearance existing when the date indicator 1 is in an immobile resting position, in order to shorten the duration of the "instantaneous jump." Normally, in fact, it takes a certain length of time (typically 1 to 2 hours) for the date indicator to advance one step. Clearance A delays the effect of the tooth 2, thus star 8 is driven for a shorter length of time. This time is likewise optimized owing to the action of jumper spring 11 of control star 8. In this way, it is possible to divide by four or more the duration of the "instantaneous jump" at the level of rotary indicating means 12. For example, an "instantaneous jump" taking place in twenty minutes (or less) now becomes possible.

Additionally a clearance B between the tooth 2 and the active tooth of control star 8 permits any disturbance of the indicating means to be avoided if the crown is rotated backward. This clearance is likewise present when date indicator 1 is in an immobile resting position. The date ring may thus be displaced angularly (opposite to the normal direction of operation) over a distance corresponding to clearance B without star 8 being driven.

In one modification, more than one rotary indicating means 12 is used (as in FIG. 6, for example). The indicating means may be used dependently, i.e., by coupling one or more additional complete or partial sets of wheels and pinions to one or the other of the driving elements 8, 9, 10, 16; or independently, i.e., by using one or more separate additional sets coupled directly to date ring 1; or else by combining these two methods.

Thus the inventive timepiece allows at least one rotary indicating means 12 to be driven simply and economically, starting from a movement with a conventional date indicator, by adding solely driving wheels and pinions (8, 9, 10, 11).

The elements added to the basic movement are simple, few in number, and inexpensive (particularly jumper spring 11, which may take the form of a simple spring blade). Furthermore, they do not affect the size of the basic movement.

It is possible to obtain a multitude of indications, singularly or in combination. For instance, it is possible to display the date through an aperture showing the date indications 7 inscribed on date indicator 1, while having at the same time an indication of the phase of the moon and/or of the "cash balance" with the aid of one or more rotary indicating means 12.

According to another modification, it is likewise possible not to show the date indications 7 inscribed on the date ring, either by using an opaque aperture or by omitting the aperture. One or more rotary indicating means 12 then permit, for example, indication of the date and/or the phase of the moon and/or the "cash balance" and/or other data.

What is claimed is:

1. A timepiece having a date indicator including inner teeth and means for moving said date indicator angularly by one step per day, the timepiece comprising:

at least one rotary indicating means driven by said inner teeth , said at least one rotary indicating means and said date indicator being disposed non-concentrically;

at least one intermediate rotary gearing organ, which meshes with said driving inner teeth of said date indicator, wherein a clearance is provided between a driven active tooth of said intermediate rotary gearing organ and one of said driving inner teeth in a direction from said driven active tooth to said driving inner teeth when the date indicator is in a resting position;

a pinion arranged integrally and coaxially with said intermediate rotary gearing organ, said pinion driving an indication wheel on which said rotary indicating means is disposed; and a jumper spring disposed to contact the intermediate rotary gearing organ.

2. The timepiece of claim 1, wherein said at least one rotary indicating means is a hand indicating the date.

3. The timepiece of claim 1, wherein said at least one rotary indicating means is a rotary disk reproducing the evolution of the lunar cycle.

4. The timepiece of claim 1, wherein said at least one rotary indicating means is a hand indicating a "cash balance".

5. The timepiece of claim 1, wherein said at least one rotary indicating means is a hand indicating the number of the week in the month.

6. The timepiece of claim 1, wherein said at least one rotary indicating means is a hand indicating the number of the week in the year.

7. The timepiece of claim 1, wherein said date indicator includes indications inscribed thereon, further comprising a dial having an aperture through which at least one of said indications appears.

8. The timepiece of claim 7, wherein said indication is the date.

9. The timepiece of claim 7, wherein said indication is the "cash balance".

10. The timepiece of claim 1, wherein said inner teeth are both driven and driving teeth.

11. The timepiece of claim 10, further comprising driving means driven by said inner teeth.

12. The timepiece of claim 10, further comprising an hour wheel and a date-driving wheel, said inner teeth being driven by said hour wheel and said date-driving wheel.

13. The timepiece of claim 1, wherein said intermediate rotary gearing organ is a control star.

14. The timepiece of claim 10, wherein said intermediate rotary gearing organ is a control star.

15. The timepiece of claim 1, comprising a plurality of independent said rotary indicating means, each indicating a different parameter.

16. The timepiece of claim 1, comprising a plurality of interdependent said rotary indicating means, each indicating a different parameter.

17. A timepiece of claim 1, comprising a "cash balance" indication.

18. The timepiece of claim 17, comprising a rotary indicating means indicating the "cash balance".

19. The timepiece of claim 17, comprising an aperture showing the "cash balance".

20. An indicator drive device for only a timepiece having a driving ring to incrementally rotate a rotatable indicator element, the driving ring having a plurality of inner teeth, the indicator drive device comprising:

a star wheel having a plurality of outwardly projecting star teeth engageable with the plurality of inner teeth of the driving ring and mounted within the timepiece for rotation about a first rotational axis;

an indicator wheel mounted within the timepiece for rotation about a second rotational axis and operably connected for rotation with said star wheel, said indicator wheel connected to the rotatable indicator element coextensively about the second rotational axis so that when the driving ring incrementally rotates, the star wheel incrementally rotates, thereby causing said indicator wheel and the rotatable indicator element to incrementally rotate, said indicator wheel including a plurality of outwardly extending indicator teeth disposed about a periphery of said indicator wheel;

pinion rotatably mounted within the timepiece and fixedly and coaxially connected to said star wheel, said pinion having a plurality of outwardly extending pinion teeth disposed circumferentially about said pinion whereby the pinion teeth and the indicator teeth are matably engaged; and spring element mounted within the timepiece and resiliently biased to maintain said star wheel in a fixed position between incremental rotations and to accelerate incremental rotation of the rotatable indicator element during incremental rotation.

21. An indicator drive device according to claim 20, wherein one of the plurality of star teeth is disposed between consecutive ones of the plurality of inner teeth in a spaced apart relationship.

22. An indicator drive device according to claim 20, wherein said indicator wheel and the rotatable indicator element are fixedly connected to each other by an indicator arbor.

* * * * *